US006190124B1

(12) United States Patent
Freling et al.

(10) Patent No.: US 6,190,124 B1
(45) Date of Patent: Feb. 20, 2001

(54) COLUMNAR ZIRCONIUM OXIDE ABRASIVE COATING FOR A GAS TURBINE ENGINE SEAL SYSTEM

(75) Inventors: Melvin Freling, West Hartford; Dinesh K. Gupta, South Windsor; Ken Lagueux, Berlin; Jeanine T. DeMasi-Marcin, Marlborough, all of CT (US)

(73) Assignee: United Technologies Corporation, Hartford, CT (US)

( * ) Notice: Under 35 U.S.C. 154(b), the term of this patent shall be extended for 0 days.

(21) Appl. No.: 08/979,065

(22) Filed: Nov. 26, 1997

(51) Int. Cl.[7] ..... F01D 5/14

(52) U.S. Cl. ..... 415/173.4; 415/200; 415/174.4; 416/241 B

(58) Field of Search ..... 415/173.4, 173.5, 415/173.7, 174.4, 174.5, 200, 230; 416/241 K, 241 B, 224

(56) References Cited

U.S. PATENT DOCUMENTS

| | | | | |
|---|---|---|---|---|
| 4,884,820 | * | 12/1989 | Jackson et al. | 415/173.4 |
| 5,238,752 | * | 8/1993 | Durerstadt et al. | 416/241 B |
| 5,314,304 | * | 5/1994 | Wiebe | 415/173.4 |
| 5,320,909 | * | 6/1994 | Scharman et al. | 415/174.4 |
| 5,603,603 | * | 2/1997 | Benoit et al. | 415/173.4 |
| 5,645,399 | | 7/1997 | Angus | 415/178 |
| 5,912,087 | * | 6/1999 | Jackson et al. | 416/241 B |

* cited by examiner

*Primary Examiner*—Edward K. Look
*Assistant Examiner*—Richard Woo
(74) *Attorney, Agent, or Firm*—George J. Romanik

(57) ABSTRACT

A gas turbine engine seal system includes a rotating member having an abrasive tip disposed in rub relationship to a stationary, abradable seal surface. The abrasive tip comprises a zirconium oxide abrasive coat having a columnar structure that is harder than the abradable seal surface such that the abrasive tip can cut the abradable seal surface.

20 Claims, 2 Drawing Sheets

FIG. 1
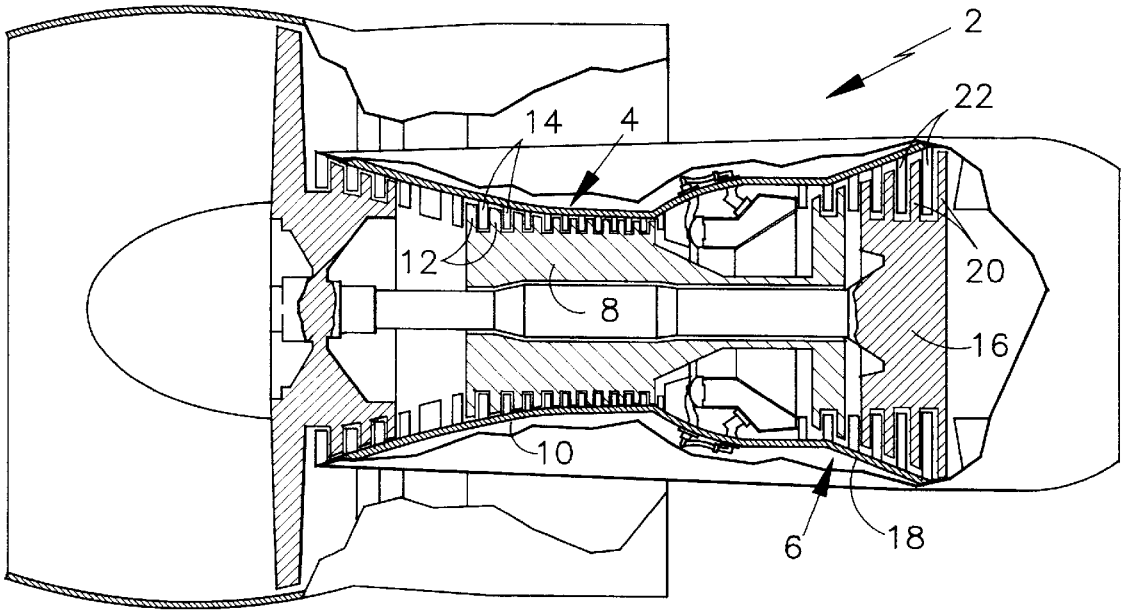
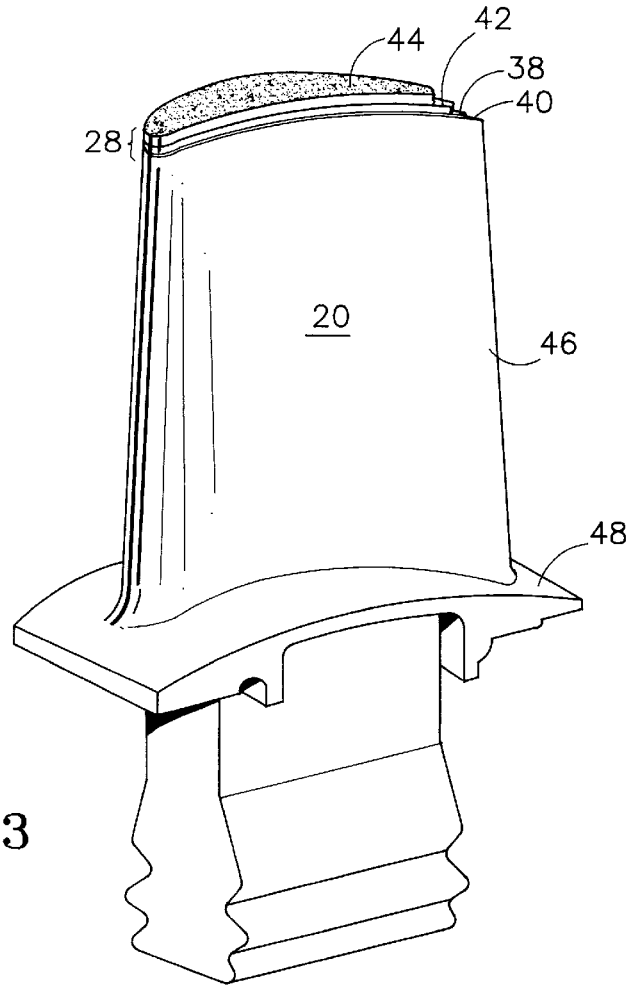
FIG. 3

FIG.2
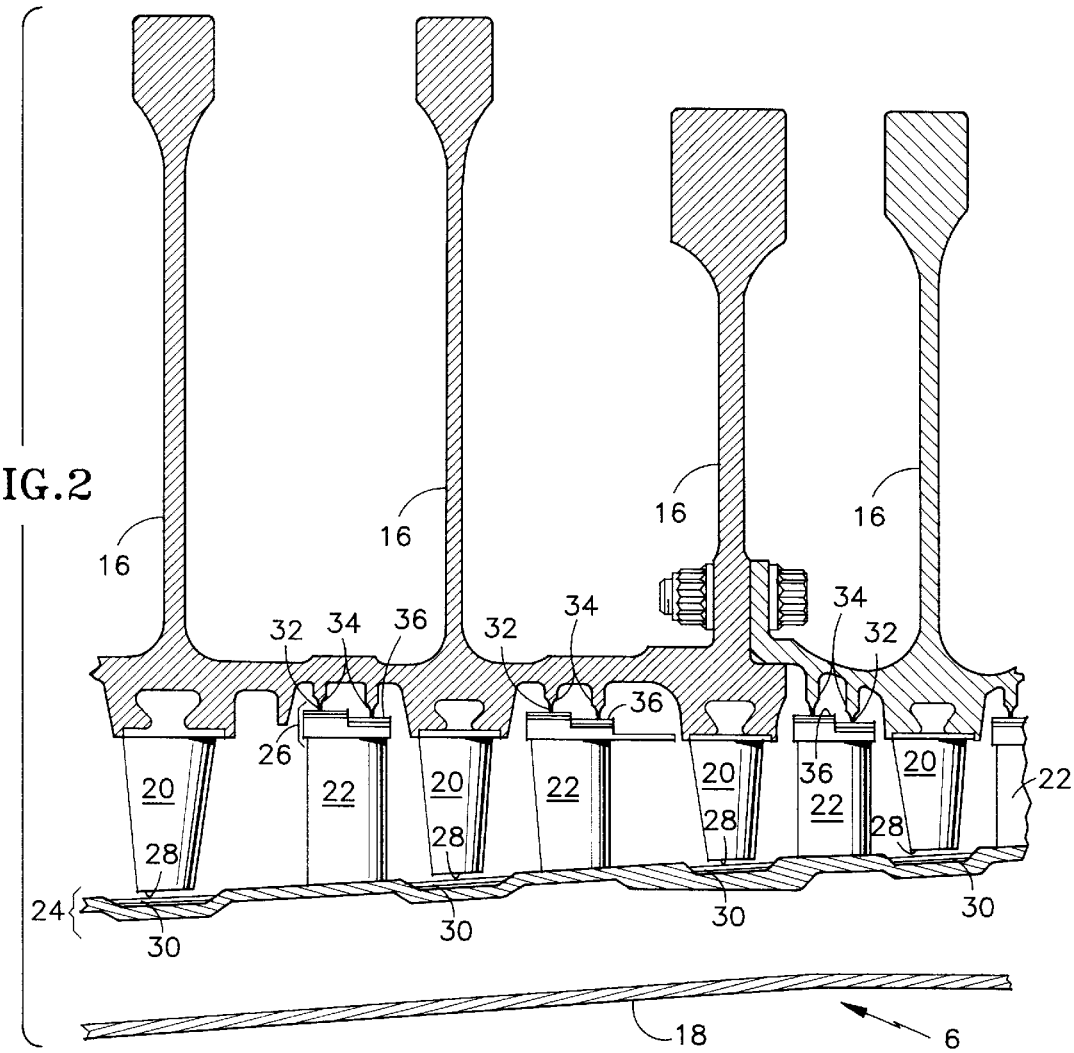
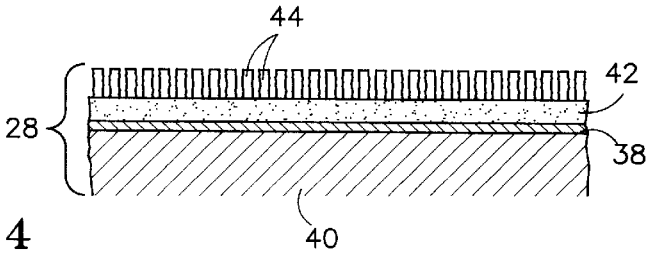
FIG.4

COLUMNAR ZIRCONIUM OXIDE ABRASIVE COATING FOR A GAS TURBINE ENGINE SEAL SYSTEM

TECHNICAL FIELD

The present invention relates generally to an abrasive coating that is applied to rotating members in gas turbine engines to enhance airseal cutting, thereby minimizing clearance losses and improving rotating member durability.

BACKGROUND ART

Gas turbine engines typically include a variety of rotary seal systems to maintain differential working pressures that are critical to engine performance. One common type of seal system includes a rotating member such as a turbine blade positioned in a rub relationship with a static, abradable seal surface. The rub relationship creates a small operating clearance between the turbine blade and seal surface to limit the amount of working gas that bypasses the turbine blade. Too large a clearance can allow undesirable amounts of working gas to escape between the turbine blade and seal surface, reducing engine efficiency. Similar seal systems are typically used as gas turbine engine inner and outer airseals in both the compressor and turbine sections.

To maintain a desirably small operating clearance, the rotating member, for example a turbine blade, typically has an abrasive tip capable of cutting the seal surface with which it is paired. When a gas turbine engine is assembled, there is a small clearance between the rotating member and seal surface. During engine operation, the rotating member grows longer due to centrifugal forces and increased engine temperature and rubs against the seal surface. The rotating member's abrasive tip cuts into the abradable seal surface to form a tight clearance. The intentional contact between the abrasive tip and seal surface, combined with thermal and pressure cycling typical of gas turbine engines, creates a demanding, high wear environment for both the seal surface and abrasive tip.

To limit seal surface erosion and spalling, thereby maintaining a desired clearance between the rotating member and seal surface, seal surfaces are typically made from relatively hard, though abradable, materials. For example, felt metal, plasma sprayed ceramic over a metallic bond coat, plasma sprayed nickel alloy containing boron nitride (BN), or a honeycomb material are commonly seal surface materials.

Unless the rotating member has an appropriate abrasive tip, the seal surface with which is paired can cause significant wear to the rotating member. In addition to degrading engine performance, this is undesirable because rotating members, particularly turbine and compressor blades, can be very expensive to repair or replace. As a result, the materials used to form abrasive tips are typically harder than the seal surfaces with which they are paired. For example, materials such as aluminum oxide ($Al_2O_3$), including zirconium oxide ($Zr_2O_3$) toughened aluminum oxide; electroplated cubic BN (cBN); tungsten carbide-cobalt (WC—Co); silicon carbide (SiC); silicon nitride ($Si_3N_4$), including silicon nitride grits cosprayed with a metal matrix; and plasma-sprayed zirconium oxide stabilized with yttrium oxide ($Y_2O_3$—$ZrO_2$) have been used for abrasive tips in some applications. Three of the more common abrasive tips are tip caps, sprayed abrasive tips, and electroplated cBN tips.

A tip cap typically comprises a superalloy "boat" filled with an abrasive grit and metal matrix. The abrasive grit may be silicon carbide, silicon nitride, silicon-aluminumoxynitride (SiAlON) and mixtures of these materials. The metal matrix may be a Ni, Co, or Fe base superalloy that includes a reactive metal such as Y, Hf, Ti, Mo, or Mn. The "boat" is bonded to the tip of a rotating member, such as a turbine blade, using transient liquid phase bonding techniques. Tip caps and the transient liquid phase bonding technique are described in commonly assigned U.S. Pat. No. 3,678,570 to Paulonis et al., U.S. Pat. No. 4,038,041 to Duval et al., U.S. Pat. No. 4,122,992 to Duval et al., U.S. Pat. No. 4,152,488 to Schilke et al., U.S. Pat. No. 4,249,913 to Johnson et al., U.S. Pat. No. 4,735,656 to Schaefer et al., and U.S. Pat. No. 4,802,828 to Rutz et al. Although tip caps have been used in many commercial applications, they can be costly and somewhat cumbersome to install onto blade tips.

A sprayed abrasive tip typically comprises aluminum oxide coated silicon carbide or silicon nitride abrasive grits surrounded by a metal matrix that is etched back to expose the grits. Such tips are described in commonly assigned U.S. Pat. No. 4,610,698 to Eaton et al., U.S. Pat. No. 4,152,488 to Schilke et al., U.S. Pat. No. 4,249,913 to Johnson et al., U.S. Pat. No. 4,680,199 to Vontell et al., U.S. Pat. No. 4,468,242 to Pike, U.S. Pat. No. 4,741,973 to Condit et al., and U.S. Pat. No. 4,744,725 to Matarese et al. Sprayed abrasive tips are often paired with plasma sprayed ceramic or metallic coated seals. Although sprayed abrasive tips have been used successfully in many engines, they can be difficult to produce and new engine hardware can show some variation in abrasive grit distribution from tip to tip. Moreover, the durability of sprayed abrasive tips may not be sufficient for some contemplated future uses.

An electroplated cBN abrasive blade tip typically comprises a plurality of cBN grits surrounded by an electroplated metal matrix. The matrix may be nickel, MCrAlY, where M is Fe, Ni, Co, or a mixture of Ni and Co, or another metal or alloy. Cubic boron nitride tips are excellent cutters because cBN is harder than any other grit material except diamond. Electroplated cBN tips are well suited to compressor applications because of the relatively low temperature (i.e., less than about 1500° F. [815° C.]) environment. Similar tips, however, may have limited life in turbine applications because the higher temperature in the turbine section can cause the cBN grits and perhaps even the metal matrix to oxidize. Although electroplated cBN tips are typically less expensive to produce than sprayed abrasive tips, the technology used to make them can be difficult and costly to implement.

Therefore, the industry needs an abrasive tip for gas turbine engine seal systems that is highly abrasive, more durable, and less expensive to produce than those presently available.

DISCLOSURE OF THE INVENTION

The present invention is directed to an abrasive tip for gas turbine engine seal systems that is highly abrasive, more durable, and less expensive to produce than those presently available.

One aspect of the invention includes a gas turbine engine seal system with a rotating member having an abrasive tip in rub relationship to a stationary, abradable seal surface. The abrasive tip, which is harder than the abradable seal surface so the abrasive tip can cut the abradable seal surface, comprises a zirconium oxide abrasive coat deposited directly onto a substantially grit-free surface on the rotating member. The zirconium oxide abrasive coat has a columnar structure and comprises zirconium oxide and about 3 wt % to about 25 wt % of a stabilizer. The stabilizer may be yttrium oxide, magnesium oxide, calcium oxide or a mixture of these materials.

In another aspect of the invention the abrasive tip comprises a metallic bond coat deposited onto a substantially grit-free surface on the rotating member, an aluminum oxide layer disposed on the metallic bond coat, and a zirconium oxide abrasive coat with a columnar structure deposited on the aluminum oxide layer. The zirconium oxide abrasive coat comprises zirconium oxide and about 3 wt % to about 25 wt % of a stabilizer, which may be yttrium oxide, magnesium oxide, calcium oxide or a mixture of these materials.

Still another aspect of the invention includes a gas turbine engine blade or knife edge having an abrasive tip. The abrasive tip comprises a zirconium oxide abrasive coat having a columnar structure, wherein the zirconium oxide abrasive coat comprises zirconium oxide and about 3 wt % to about 25 wt % of a stabilizer selected from the group consisting of yttrium oxide, magnesium oxide, calcium oxide and a mixture thereof.

These and other features and advantages of the present invention will become more apparent from the following description and accompanying drawing.

BRIEF DESCRIPTION OF THE DRAWING

FIG. 1 is a cut-away perspective view of a gas turbine engine.

FIG. 2 is a sectional view of compressor outer and inner airseals of the present invention.

FIG. 3 is a perspective view of a turbine blade having an abrasive tip of the present invention.

FIG. 4 is an enlarged view of the columnar structure of the abrasive tip of the present invention.

BEST MODE FOR CARRYING OUT THE INVENTION

The abrasive tip of the present invention can be used in high wear gas turbine engine applications that require the maintenance of tight clearances between rotating and static members. For example the present invention is particularly suited for use as an abrasive turbine or compressor blade tip or turbine or compressor knife edge. The abrasive blade tip or knife edge of the present invention may be paired with a suitable abradable seal surface to form an outer or inner airseal.

FIG. 1 shows a typical gas turbine engine 2 that includes a compressor section 4 and a turbine section 6. The compressor section 4 includes a compressor rotor 8 disposed inside a compressor case 10. A plurality of compressor blades 12, one of the rotating members in the engine, are mounted on the rotor 8 and a plurality of compressor stators 14 are disposed between the blades 12. Similarly, the turbine section 6 includes a turbine rotor 16 disposed inside a turbine case 18. A plurality of turbine blades 20, another of the rotating members in the engine, are mounted on the rotor 16 and a plurality of turbine vanes 22 are disposed between the blades 20.

FIG. 2 shows a compressor section 4 outer airseal 24 and inner airseal 26. Each outer airseal 24 includes an abrasive tip 28 disposed on the end of a compressor blade 12 in rub relationship to an abradable outer seal surface 30. For purposes of this application, two components are in rub relationship when the clearance between them allows direct contact between the components at least one time when an engine is run after assembly. Each inner airseal 26 includes an abrasive tip 32 disposed on the end of a compressor knife edge 34 in rub relationship to an abradable inner seal surface 36 disposed on a compressor stator 14. A person skilled in the art will appreciate that similar outer and inner airseals can similar to those described above may be used in the turbine section 6 and other engine sections in addition to the compressor section 4.

FIG. 3 shows a turbine blade 20 of the present invention having an abrasive tip 28 that comprises a metallic bond coat 38 deposited on the end 40 of the turbine blade 20, and aluminum oxide ($Al_2O_3$) layer 42 on the bond coat 38 and a zirconium oxide ($ZrO_2$) abrasive coat 44 deposited on the aluminum oxide layer 42. The abrasive tip of the present invention may be deposited directly onto a rotating member as shown or may be deposited over an undercoating on or diffused into the surface of the rotating member. For example, the abrasive tip of the present invention may be deposited over a diffusion aluminide coating diffused into the surface of the rotating member. The abrasive tip of the present invention, however, should be applied to a surface that is substantially free of abrasive grit to avoid duplicating the abrasive function of the grit and adding additional cost to the component. The abrasive tip 32 on a knife edge 34 could be configured similarly. In either case, the rotating member (i.e., turbine or compressor blade 20, 12, compressor knife edge 34, or turbine knife edge [not shown]) to which the abrasive tip 28, 32 of the present invention is applied typically comprises a nickel-base or cobalt-base superalloy or a titanium alloy.

Although FIG. 3, shows an abrasive tip 28 of the present invention that includes a metallic bond coat 38, the bond coat is optional and may be deleted if the zirconium oxide abrasive coat 44 adheres well to the rotating member to which it is applied without a bond coat 38. If no bond coat is used, it may be desirable to make the rotating member from an alloy capable of forming an adherent aluminum oxide layer comparable to aluminum oxide layer 42. One such alloy has a nominal composition of 5.0Cr-10Co-1.0Mo-5.9W-3.0Re-8.4Ta-5.65Al-0.25Hf-0.013Y, balance Ni. In most applications, a bond coat 38 is preferred to provide good adhesion between the abrasive tip 28, 32 and rotating member and to provide a good surface for forming the aluminum oxide layer 42 and applying the zirconium oxide abrasive coat 44. Appropriate selection of a bond coat 38 will limit or prevent both spalling of the zirconium oxide abrasive coat 44 from the bond coat 38 or spalling of the entire abrasive tip 28, 32 during engine operation. Spalling of the zirconium oxide abrasive coat 44 or the entire abrasive tip 28, 32 during operation can decrease rotating member durability and impair engine performance by increasing the operating clearance between the rotating member and abradable seal surface.

The metallic bond coat 38 of the present invention may be any metallic material known in the art that can form a durable bond between a gas turbine engine rotating member and zirconium oxide abrasive coat 44. Such materials typically comprise sufficient Al to form an adherent layer of aluminum oxide that provides a good bond with the zirconium oxide abrasive coat 44. For example, the metallic bond coat 38 may comprise a diffusion aluminide, including an aluminide that comprises one or more noble metals; an alloy of Ni and Al; or an MCrAlY, wherein the M stands for Fe, Ni, Co, or a mixture of Ni and Co. As used in this application, the term MCrAlY also encompasses compositions that include additional elements or combinations of elements such as Si, Hf, Ta, Re or noble metals as is known in the art. The MCrAlY also may include a layer of diffusion aluminide, particularly an aluminide that comprises one or more noble metals. Preferably, the metallic bond coat 38 will comprise an MCrAlY of the nominal composition Ni-22Co-17Cr-12.5Al-0.25Hf-0.4Si-0.6Y. This composition is further described in commonly assigned U.S. Pat. Nos. 4,585,481 and Re 32,121, both to Gupta et al., both of which are incorporated by reference.

The metallic bond coat 38 may be deposited by any method known in the art for depositing such materials. For example, the bond coat 38 may be deposited by low pressure plasma spray (LPPS), air plasma spray (APS), electron beam physical vapor deposition (EB-PVD), electroplating, cathodic arc, or any other method. The metallic bond coat 38 should be applied to the rotating member to a thickness sufficient to provide a strong bond between the rotating member and zirconium oxide abrasive coat 44 and to prevent cracks that develop in the zirconium oxide abrasive coat 44 from propagating into the rotating member. For most applications, the metallic bond coat 38 may be about 1 mil (25 μm) to about 10 mils (250 μm) thick. Preferably, the bond coat 38 will be about 1 mil (25 μm) to about 3 mils (75 μm) thick. After depositing the metallic bond coat 38, it may be desirable to peen the bond coat 38 to close porosity or leaders that may have developed during deposition or to perform other mechanical or polishing operations to prepare the bond coat 38 to receive the zirconium oxide abrasive coat 44.

The aluminum oxide layer 42, sometimes referred to as thermally grown oxide, may be formed on the metallic bond coat 38 or rotating member by any method that produces a uniform, adherent layer. As with the metallic bond coat 38, the aluminum oxide layer 42 is optional. Preferably, however, the abrasive tip 28 will include an aluminum oxide layer 42. For example, the layer 42 may be formed by oxidation of Al in either the metallic bond coat 38 or rotating member at an elevated temperature before the application of the zirconium oxide abrasive coat 44. Alternately, the aluminum oxide layer 42 may be deposited by chemical vapor deposition or any other suitable deposition method know in the art. The thickness of the aluminum oxide layer 42, if present at all, may vary based its density and homogeneity. Preferably, the aluminum oxide layer 42 will about 0.004 mils (0.1 μm) to about 0.4 mils (10 μm) thick.

The zirconium oxide abrasive coat 44 may comprise a mixture of zirconium oxide and a stabilizer such as yttrium oxide ($Y_2O_3$), magnesium oxide (MgO), calcium oxide (CaO), or a mixture thereof. Yttrium oxide is the preferred stabilizer. The zirconium oxide abrasive coat 44 should include enough stabilizer to prevent an undesirable zirconium oxide phase change (i.e. a change from a preferred tetragonal or cubic crystal structure to the less desired monoclinic crystal structure) over the range of operating temperature likely to be experienced in a particular gas turbine engine. Preferably, the zirconium oxide abrasive coat 44 will comprise a mixture of zirconium oxide and about 3 wt % to about 25 wt % yttrium oxide. Most preferably, the zirconium oxide abrasive coat 44 will comprise about 6 wt % to about 8 wt % yttrium oxide or about 11 wt % to about 13 wt % yttrium oxide, depending on the intended temperature range.

As FIG. 4 shows, the zirconium oxide abrasive coat 44 should have a plurality of columnar segments homogeneously dispersed throughout the abrasive coat such that a cross-section of the abrasive coat normal to the surface to which the abrasive coat is applied exposes a columnar microstructure typical of physical vapor deposited coatings. The columnar structure should have a length that extends for the full thickness of the zirconium oxide abrasive coating 44. Such coatings are described in commonly assigned U.S. Pat. No. 4,321,310 to Ulion et al., U.S. Pat. No. 4,321,311 to Strangman, U.S. Pat. No. 4,401,697 to Strangman, U.S. Pat. No. 4,405,659 to Strangman, U.S. Pat. No. 4,405,660 to Ulion et al., U.S. Pat. No. 4,414,249 to Ulion et al., and U.S. Pat. No. 5,262,245 to Ulion et al., all of which are incorporated by reference. In some applications it may be desirable to apply substantially the same coating as used for the abrasive tip 38 as a thermal barrier coating on an airfoil surface 46 or platform 48 of the blade 20.

The zirconium oxide abrasive coat 44 may be deposited by EB-PVD or any other physical vapor deposition method known to deposit columnar coating structures. Preferably, the abrasive coat 44 of the present invention will be applied by EB-PVD because of the availability of EB-PVD equipment and skilled technicians. As discussed above, the abrasive coat 44 may be applied over a metallic bond coat 38 or directly to a rotating member, in both cases, preferably in conjunction with an aluminum oxide layer 42. In either case, the abrasive coat 44 should be applied a thickness sufficient to provide a strong bond with the surface to which it is applied. For most applications, the abrasive coat 44 may be about 5 mils (125 μm) to about 50 mils (1250 μm) thick. Preferably, the abrasive coat 44 will be about 5 mils (125 μm) to about 25 mils (625 μm) thick. When applied to turbine or compressor blades, a relatively thick abrasive coat 44 may be desirable to permit assembly grinding of the compressor or turbine rotor in which they are installed. Assembly grinding removes some of the abrasive coat 44 from the blade tips to compensate for slight is variations in coating thickness that develop due to tolerances in the deposition process. Starting with a relatively thick abrasive coat 44 allows the assembly grinding procedure to produce a substantially round rotor, while preserving a final abrasive coat 44 that is thick enough to effectively cut a seal surface.

The abradable seal surfaces 30,36 of the present invention may comprise any materials known in the art that have good compatibility with the gas turbine engine environment and can be cut by the abrasive coat 44. For high pressure turbine applications, the preferred abradable seal material comprises a metallic bond coat (nominally 5.0Cr-10Co-1.0Mo-5.9W-3.0Re-8.4Ta-5.65Al-0.25Hf-0.013Y, balance Ni) and a porous ceramic layer (nominally zirconium oxide stabilized with about 7 wt % yttrium oxide). The bond coat may be applied by either plasma spray or high velocity oxy-fuel deposition. The ceramic layer may be deposited by plasma spraying a mixture of about 88 wt % to about 99 wt % ceramic powder and about 1 wt % to about 12 wt % aromatic polyester resin. The polyester resin is later burned out of the ceramic layer to produce a porous structure. For high pressure compressor applications, the preferred abradable seal material comprises a nickel-based superalloy bond coat and a combination of a nickel-based superalloy (nominally 9Cr-9W-6.8Al-3.25Ta-0.02C, balance Ni and minor elements included to enhance oxidation resistance) and boron nitride as a top coat. The bond coat may be formed by plasma spraying a powder formed by a rapid solidification rate method. The top coat may be formed by plasma spraying a mixture of the bond coat powder and boron nitride powder. Another possible abradable seal material comprises a graded plasma sprayed ceramic material that includes successive layers of a metallic bond coat (nominally Ni-6Al-18.5Cr), a graded metallic/ceramic layer (nominally Co-23Cr-13Al-0.65Y/aluminum oxide), a graded, dense ceramic layer (nominally aluminum oxide/zirconium oxide stabilized with about 20 wt % yttrium oxide), and a porous ceramic layer (nominally zirconium oxide stabilized with about 7 wt % yttrium oxide). Other possible seal surface materials include felt metal and a honeycomb material. Suitable seal surface materials are described in commonly assigned U.S. Pat. No. 4,481,237 to Bosshart et al., U.S. Pat. No. 4,503,130 to Bosshart et al., U.S. Pat. No. 4,585,481 to Gupta et al., U.S. Pat. No. 4,588,607 to Matarese et al., U.S. Pat. No. 4,936,745 to Vine et al., U.S. Pat. No. 5,536,022 to Sileo et al., and U.S. Pat. No. Re 32,121 to Gupta et al, all of which are incorporated by reference.

The following example demonstrates the present invention without limiting the invention's broad scope.

EXAMPLE

Columnar zirconium oxide abrasive tips of the present invention were applied to 0.25 inch (0.64 cm)×0.15 inch (0.38 cm) rectangular rub rig specimens by conventional deposition techniques. The tips included a low pressure plasma spray metallic bond coat about 3 mils (75 μm) thick that nominally comprised Ni-22Co-17Cr-12.5Al-0.25Hf-0.4Si-0.6Y. After deposition, the metallic bond coat was diffusion heat treated at about 1975° F. (1079° C.) and peened by gravity assist shot peening. A TGO layer about 0.04 mil (1 μm) thick was grown on the surface of the bond coat by conventional means. Finally about 5 mils (125 μm) of columnar ceramic comprising zirconium oxide stabilized with 7 wt % yttrium oxide were applied by a conventional electron beam physical vapor deposition process. The coated specimen was placed into a rub rig opposite a seal material that comprised successive layers of a Ni-6Al-18.5Cr metallic bond coat; a graded layer of Co-23Cr-13Al-0.65Y and aluminum oxide; a graded, dense ceramic layer of aluminum oxide and zirconium oxide stabilized with about 20 wt % yttrium oxide; and a porous layer of zirconium oxide stabilized with about 7 wt % yttrium oxide. The rub rig was started with the seal surface at ambient temperature and was operated to generate a tip speed of 1000 ft/s (305 m/s) and an interaction rate between the tip and seal surface of 10 mils/s (254 μm/s). The test was run until the tip reached a depth of 20 mils (508 μm). Once the desired depth was reached, the rub rig was stopped and the specimens were removed for analysis to determine the amount of wear on the tip and seal surface. Table 1 shows data from the test.

TABLE 1

| Specimen | 1 | 2 |
|---|---|---|
| Seal Rub Temperature-° F. (° C.) | 2200 (1204) | 1925 (1052) |
| Blade Rub Temperature-° F. (° C.) | 2800 (1538) | 2105 (1152) |
| Average Blade Wear-mil (μm) | 7.0 (177.8) | 10.0 (254.0) |
| Average Seal Wear-mil (μm) | 12.0 (304.8) | 9.0 (228.6) |
| Total Interaction-mil (μm) | 19.0 (482.6) | 19.0 (482.6) |
| Linear Wear (W/I) | 0.368 | 0.526 |
| Volume Wear (VWR) | 0.075 | 0.071 |

Linear wear (W/I) is a ratio of the linear amount of abrasive tip removed from the rotating member to the sum of the linear amount of material removed from the rotating and static members together. The lower the value of W/I, the better the abrasive tip is at cutting the seal material. Although the W/I ratio is an easy and helpful way of analyzing blade tip wear, it is dependent on the geometry of the specimen and seal surface used in the rub rig. An alternate measure of wear, volume wear ratio (VWR), is not dependent on specimen and seal surface geometry. VWR is the ratio of abrasive tip volume lost per volume of seal coating removed during a rub event. Again, a lower value to this ratio indicates that the abrasive tip is more effective at cutting the seal material.

Table 2 compares the VWR results from the Example to data for prior art aluminum oxide tips toughened with zirconium oxide, cospray blade tips, sprayed abrasive tips, and electroplated cBN tips when rubbed against the same seal surface material used in Example 1.

TABLE 2

| Tip Configuration | Average VWR |
|---|---|
| Aluminum oxide toughened with zirconium oxide (prior art) | 1.4 |
| Cospray (prior art) | 1.18 |
| Sprayed abrasive tip (prior art) | 0.63 |
| Electroplated cBN (prior art) | <0.01 |
| Columnar zirconium oxide (present invention) | 0.07 |

Although the rub rig test showed that columnar zirconium oxide abrasive tips of the present invention did not perform quite as well as electroplated cBN tips, they did perform significantly better than other prior art tips. Moreover, columnar zirconium oxide abrasive tips present several advantageous over cBN tips. For example, they are not prone to oxidation problems. Also, columnar zirconium oxide abrasive tips can simplify manufacturing processes when used with EB-PVD thermal barrier coatings on a blade's airfoil and platform. This can be done at the same time and improve the integrity of both the coating and tip in the tip area compared with similar data for other abrasive tip configurations.

The invention is not limited to the particular embodiments shown and described in this specification. Various changes and modifications may be made without departing from the spirit or scope of the claimed invention.

We claim:

1. A gas turbine engine seal system, comprising a rotating member having an abrasive tip disposed in rub relationship to a stationary, abradable seal surface, wherein the abrasive tip comprises a material harder than the abradable seal surface such that the abrasive tip can cut the abradable seal surface, characterized in that:

the abrasive tip comprises a metallic bond coat deposited onto a substantially grit-free surface on the rotating member, an aluminum oxide layer disposed on the metallic bond coat, and a zirconium oxide abrasive coat having a columnar structure is deposited on the aluminum oxide layer, wherein the zirconium oxide abrasive coat comprises zirconium oxide and about 3 wt % to about 25 wt % of a stabilizer selected from the group consisting of yttrium oxide, magnesium oxide, calcium oxide and a mixture thereof.

2. The seal system of claim 1, wherein the metallic bond coat comprises a diffusion aluminide, an alloy of Ni and Al, or MCrAlY, wherein M stands for Ni, Co, Fe, or a mixture of Ni and Co.

3. The seal system of claim 1, wherein the rotating member is a turbine blade.

4. The seal system of claim 3, wherein the turbine blade has an airfoil portion and a platform portion and the airfoil portion or the platform portion or both are at least partly coated with a columnar thermal barrier coating having substantially the same composition as the abrasive tip.

5. The seal system of claim 1, wherein the rotating member is a turbine rotor knife edge disposed on a turbine rotor and the abradable seal surface is disposed on a turbine vane to form an inner air seal.

6. The seal system of claim 1, wherein the rotating member is a compressor blade.

7. The seal system of claim 1, wherein the rotating member is a compressor rotor knife edge disposed on a compressor rotor and the abradable seal surface is disposed on a compressor stator to form an inner air seal.

8. A gas turbine engine seal system, comprising a rotating member having an abrasive tip disposed in rub relationship to a stationary, abradable seal surface, wherein the abrasive tip comprises a material harder than the abradable seal surface such that the abrasive tip can cut the abradable seal surface, characterized in that:

the abrasive tip comprises a zirconium oxide abrasive coat having a columnar structure, wherein the zirconium oxide abrasive coat comprises zirconium oxide and about 3 wt % to about 25 wt % of a stabilizer selected from the group consisting of yttrium oxide, magnesium oxide, calcium oxide and mixtures thereof and the abrasive tip is deposited onto a substantially grit-free surface on the rotating member.

9. The seal system of claim 8, wherein the abrasive tip further comprises an aluminum oxide layer disposed between the zirconium oxide abrasive coat and the rotating member.

10. The seal system of claim 8, wherein the rotating member is a turbine blade.

11. The seal system of claim 10, wherein the turbine blade has an airfoil portion and a platform portion and the airfoil portion or the platform portion or both are at least partly coated with a columnar thermal barrier coating having the same composition as the abrasive tip.

12. The seal system of claim 8, wherein the rotating member is a turbine rotor knife edge disposed on a turbine rotor and the abradable seal surface is disposed on a turbine vane to form an inner air seal.

13. The seal system of claim 8, wherein the rotating member is a compressor blade.

14. The seal system of claim 8, wherein the rotating member is a compressor rotor knife edge disposed on a compressor rotor and the abradable seal surface is disposed on a compressor stator to form an inner air seal.

15. A gas turbine engine blade comprising an abrasive tip, wherein the abrasive tip comprises a zirconium oxide abrasive coat having a columnar structure, wherein the zirconium oxide abrasive coat comprises zirconium oxide and about 3 wt % to about 25 wt % of a stabilizer selected from the group consisting of yttrium oxide, magnesium oxide, calcium oxide and a mixture thereof.

16. The blade of claim 15, wherein the abrasive tip further comprises a metallic bond coat comprising a diffusion aluminide, an alloy of Ni and Al, or MCrAlY, wherein M stands for Ni, Co, Fe, or a mixture of Ni and Co, disposed between the zirconium oxide abrasive coat and the blade.

17. The blade of claim 15, wherein the abrasive tip further comprises an aluminum oxide layer disposed between the zirconium oxide abrasive coat and the blade.

18. A gas turbine engine knife edge comprising an abrasive tip, wherein the abrasive tip comprises a zirconium oxide abrasive coat having a columnar structure, wherein the zirconium oxide abrasive coat comprises zirconium oxide and about 6 wt % to about 20 wt % of a stabilizer selected from the group consisting of yttrium oxide, magnesium oxide, calcium oxide and a mixture thereof.

19. The knife edge of claim 18, wherein the abrasive tip further comprises a metallic bond coat comprising a diffusion aluminide, an alloy of Ni and Al or MCrAlY, wherein M stands for Ni, Co, Fe, or a mixture of Ni and Co, disposed between the zirconium oxide abrasive coat and the knife edge.

20. The knife edge of claim 18, wherein the abrasive tip further comprises an aluminum oxide layer disposed between the zirconium oxide abrasive coat and the knife edge.

* * * * *